United States Patent [19]

Backlund

[11] Patent Number: 4,540,041

[45] Date of Patent: Sep. 10, 1985

[54] ARRANGEMENT FOR TUBULAR HEAT EXCHANGERS LOCATED IN A LAKE

[75] Inventor: Lennart Backlund, Frösön, Sweden

[73] Assignee: Forenade Fabriksverken, Eskilstuna, Sweden

[21] Appl. No.: 487,872

[22] Filed: Apr. 22, 1983

[30] Foreign Application Priority Data

Apr. 23, 1982 [SE] Sweden ..... 8202548

[51] Int. Cl.[3] ..... F28D 7/00

[52] U.S. Cl. ..... 165/45; 405/172

[58] Field of Search ..... 60/260; 165/45; 405/217, 172, 130, 131; 126/433

[56] References Cited

U.S. PATENT DOCUMENTS

| | | | |
|---|---|---|---|
| 3,467,013 | 9/1969 | Conner | 405/172 X |
| 3,986,366 | 10/1976 | Dinsmore, Jr. | 405/172 |
| 4,187,039 | 2/1980 | Jahns et al. | 405/217 |
| 4,338,045 | 7/1982 | Cour | 405/172 |
| 4,389,034 | 6/1983 | Suttles | 405/172 X |
| 4,407,351 | 10/1983 | Backlund | 62/260 X |
| 4,416,261 | 11/1983 | van der Aa | 126/433 |
| 4,438,759 | 3/1984 | Kitajina et al. | 126/433 |
| 4,440,151 | 4/1984 | Yamamoto et al. | 126/433 |

*Primary Examiner*—William R. Cline
*Assistant Examiner*—Peggy A. Neils
*Attorney, Agent, or Firm*—Fleit, Jacobson, Cohn & Price

[57] ABSTRACT

An arrangement of tubular exchangers located in a lake for anchorage of the heat exchanger to the bottom of the lake. A number of the colder portions of the inlet side of a circulating heat exchanger medium of the heat exchangers are connected to heat pipes frozen in the bottom of a lake. The heat pipes, sealed at both ends, as a result of heat transfer from the bottom of the lake become frozen in position and anchor the tubular heat exchangers to the lake bottom.

3 Claims, 3 Drawing Figures

ARRANGEMENT FOR TUBULAR HEAT EXCHANGERS LOCATED IN A LAKE

The present invention relates to an arrangement of tubular heat exchangers located in a lake for anchoring the heat exchanger to the bottom of the lake.

Hitherto the anchoring of tubular heat exchangers located in lakes has been undertaken by means of weights or piling etc. at the bottom of the lake. This is an expensive and difficult method of anchorage.

The aim of the present invention is hence to provide an arrangement of the type specified in the introduction which is both cheap and easy to employ. This aim is achieved in that the arrangement in accordance with the invention is given the characteristics as specified in claim 1.

Further developments of the invention are described in the subclaims.

The invention will be described in greater detail by reference to the appended drawings which illustrate a preferred embodiment of the invention.

FIG. 1 provides a view, from the top, of a number of heat exchanger tubes forming part of a tubular heat exchanger located in a lake.

Figure 1:
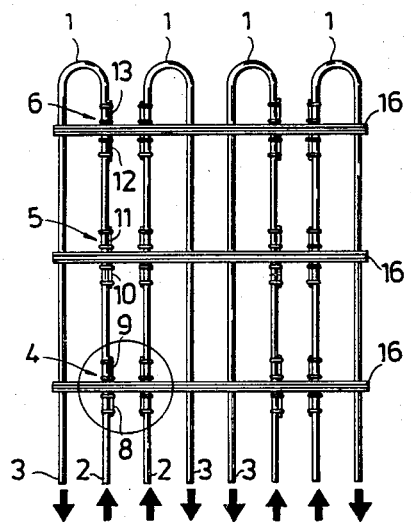
Figure 2:
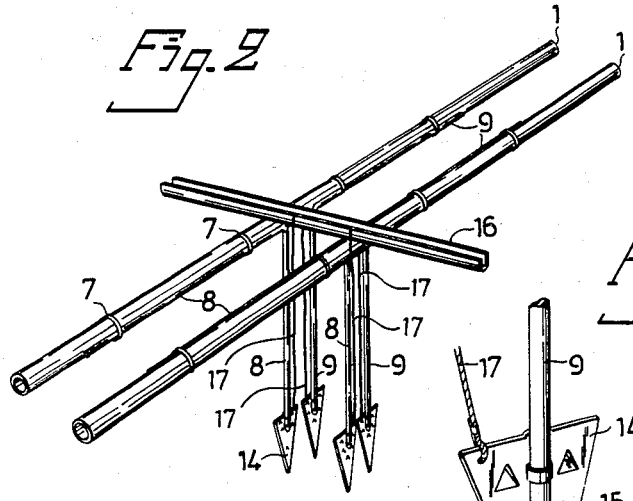
FIG. 2 illustrates, in perspective view from the top, a batch of two tubes in accordance with FIG. 1, to which four heat pipes are connected.

FIG. 1 illustrates a tubular heat exchanger located in a lake, which consists of a number of horizontally arranged plastic tubes 1 for the recovery of heat from the water and the bottom of the lake. The tubes 1, which extend in a U-shaped loop, are arranged so that at an input end 2 they are supplied with a cold heat exchanger medium, e.g. a liquid with reduced freezing point at, for example, a temperature of −4° C., which leaves the tube 1 at an output end 3 where, as a result of absorption of the heat from the lake, the temperature has risen, e.g. up to +1° C.

The portion of the tube 1, i.e. the coldest portion thereof, located nearest to the inlet end 2, is connected in a heat transfer relation at several, e.g. three different, points 4–6 by means of clamps or tape 7 with one end of two L-shaped exchanger tubes 8–9, 10–11, or 12–13 respectively. The heat exchanger tubes 8–13 are of the type which are normally designated as heat pipes, i.e. sealed tubes having both ends sealed containing freon or a similar refrigerant. The function of such heat pipes is described in the following.

Figure 3:
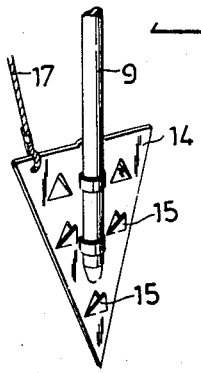
FIG. 3 shows a perspective view from the side of a moulded plate connected with a heat pipe in accordance with FIG. 2.

Each of the other ends of these heat pipes is connected as shown in FIG. 3, with its moulded triangular plate 14, which is immersed in the bottom of the lake. The plates 14 have fins 15, which are suitably bent outwards, and which render difficult upward movement of the plate from the lake bed.

The refrigerant in each heat pipe 8–13 absorbs heat from the bottom of the lake. As a result the refrigerant in each heat pipe 8–13 is vaporised and ascends to the L-shaped portion of heat pipe 8–13 held along tube 1 by clamps or tape 7, during which it is cooled by the colder portion 4–6 on the inlet side 2 of the circulating heat exchanger medium of the heat exchanger. As a result the refrigerant reverts to a liquid which runs down to the lower portion of the said heat pipe, after which the sequence is repeated. As a result of heat being transferred by this means from the bottom of the lake, ice is formed around the lower portion of each heat pipe, so that this freezes firmly in the bottom of the lake, thus providing the desired anchorage effect.

In addition, so as to reduce the risk of the tubes 1 floating upwards, a number, three in the example illustrated, of U-shaped beams 16 are placed against the upper face of the tube 1 transverse to its orientation, so that by means of their wires 17 each of the beams 16 is connected with the plate 14 which is buried in the lake bed.

I claim:

1. Heat exchange apparatus adapted to be anchored to the bottom of a lake, said heat exchange apparatus comprising a heat exchanger means adapted to circulate a heat exchanger medium for absorbing heat from a lake, a first end of a plurality of heat pipes are connected in a heat transfer relation with said heat exchanger means, said plurality of heat pipes being sealed at both ends and each forming a closed housing for a refrigerant, means for anchoring said heat exchanger means adapted to anchor said heat exchanger means to the bottom of the lake, said means for anchoring comprises a plate and a second end of said plurality of heat pipes adapted to be buried in the bottom of the lake in heat transfer contact with the bottom of the lake, and when said second end of said plurality of heat pipes is buried in heat transfer contact with the bottom of the lake, heat is transferred from the bottom of the lake to the refrigerant and from the refrigerant to the heat exchanger means connected in said heat transfer relation with said first end of said plurality of heat pipes, the second end of said plurality of heat pipes thereby becoming solidly frozen in place as a result of heat being transferred from the bottom of the lake and forming ice at the bottom of the lake, so that the heat exchanger means becomes anchored to the bottom of the lake.

2. Heat exchange apparatus as in claim 1, characterized by a number of beams which hold down the heat exchanger means and which are located adjacent to the top side of the heat exchanger means and are connected by means of a wire with the moulded plate.

3. An apparatus for anchoring a heat exchanger to the bottom of a lake, said heat exchanger transferring heat from the lake to the shore, said apparatus comprising:

a plurality of heat pipes sealed at both ends, a refrigerant sealed within said plurality of heat pipes, means for securing one end of said plurality of pipes in a heat transfer relation with said heat exchanger, and means for anchoring said heat exchanger in heat transfer contact with the bottom of the lake, the other end of the said plurality of pipes terminating in said means for anchoring at a depth sufficient to assure substantial contact of said pipes and the bottom of the lake when said means for anchoring is positioned in the bottom of the lake, said means for anchoring becoming solidly frozen in place as a result of heat being transferred from the bottom of the lake, so that the heat exchanger becomes anchored to the bottom of the lake.

* * * * *